US009879853B2

(12) United States Patent
Brodesser et al.

(10) Patent No.: US 9,879,853 B2
(45) Date of Patent: Jan. 30, 2018

(54) STEAM GENERATOR

(75) Inventors: Joachim Brodesser, Nuremberg (DE); Martin Effert, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 138 days.

(21) Appl. No.: 13/641,988

(22) PCT Filed: Apr. 5, 2011

(86) PCT No.: PCT/EP2011/055229

§ 371 (c)(1),
(2), (4) Date: Oct. 18, 2012

(87) PCT Pub. No.: WO2011/134749

PCT Pub. Date: Nov. 3, 2011

(65) Prior Publication Data

US 2014/0041601 A1 Feb. 13, 2014

(30) Foreign Application Priority Data

Apr. 30, 2010 (DE) ..... 10 2010 028 426

(51) Int. Cl.

| | |
|---|---|
| ***F22B 21/02*** | (2006.01) |
| ***F22B 29/06*** | (2006.01) |
| ***F22D 1/02*** | (2006.01) |
| ***F22B 31/00*** | (2006.01) |
| ***F01K 7/40*** | (2006.01) |

(Continued)

(52) U.S. Cl.

CPC ..... *F22B 29/06* (2013.01); *F01K 7/40* (2013.01); *F22B 21/02* (2013.01); *F22B 29/062* (2013.01); *F22B 31/0038* (2013.01); *F22B 37/143* (2013.01); *F22D 1/003* (2013.01); *F22D 1/02* (2013.01)

(58) Field of Classification Search

CPC .... F22B 31/003; F22B 31/023; F22B 29/062; F22B 29/06; F22B 21/02; F22D 1/02; F01K 7/40

USPC ..... 122/1 B, 1 C, 412, 422, 448.2

See application file for complete search history.

(56) References Cited

U.S. PATENT DOCUMENTS 3,368,534 A * 2/1968 Gorzegno et al. ..... 122/480
3,872,836 A * 3/1975 Gorzegno et al. ..... 122/406.4

(Continued)

FOREIGN PATENT DOCUMENTS

EP 0064092 A1 11/1982
EP 0320403 A1 6/1989

(Continued)

*Primary Examiner* — Alissa Tompkins
*Assistant Examiner* — Benjamin W Johnson

(57) ABSTRACT

A steam generator is provided. The steam generator has a combustion chamber having a peripheral wall formed at least partially from gas-proof, welded steam generator pipes, at least two additional inner walls formed at least partially from additional steam generator pipes which are arranged inside the combustion chamber. The inner walls are connected one behind the other on the flow medium side by an intermediate collector. The steam generator has a high service life and is reliable. The flow medium on the inlet of the inner wall upstream of the intermediate collector has a lower temperature than that of the flow medium on an inlet of the peripheral wall.

5 Claims, 2 Drawing Sheets

(51) Int. Cl.
*F22B 37/14* (2006.01)
*F22D 1/00* (2006.01)

(56) References Cited

U.S. PATENT DOCUMENTS

| | | | | |
|---|---|---|---|---|
| 4,003,205 | A * | 1/1977 | Matsumura | 60/646 |
| 5,168,819 | A * | 12/1992 | Semedard et al. | 110/245 |
| 5,247,907 | A * | 9/1993 | Lee et al. | 122/1 R |
| 6,213,059 | B1 * | 4/2001 | Gralton et al. | 122/1 B |
| 6,250,258 | B1 * | 6/2001 | Liebig | 122/406.5 |
| 6,675,747 | B1 | 1/2004 | Goidich et al. | |
| 2006/0254251 | A1 * | 11/2006 | Yamada | 60/39.19 |

FOREIGN PATENT DOCUMENTS

| | | | |
|---|---|---|---|
| EP | 0561220 | A1 | 9/1993 |
| JP | H074605 | A | 1/1995 |

* cited by examiner

STEAM GENERATOR

CROSS REFERENCE TO RELATED APPLICATIONS

This application is the US National Stage of International Application No. PCT/EP2011/055229 filed Apr. 5, 2011 and claims the benefit thereof. The International Application claims the benefits of German application No. 10 2010 028 426.2 filed Apr. 30, 2010, both of the applications are incorporated by reference herein in their entirety.

FIELD OF THE INVENTION

The invention relates to a steam generator comprising a combustion chamber having a peripheral wall formed at least partly from gas-proof, welded steam generator pipes, wherein at least two inner walls formed at least partly from additional steam generator pipes are arranged inside the combustion chamber, which are connected one behind the other on the flow medium side by an intermediate collector. It also relates to a method for operating such a steam generator.

BACKGROUND OF THE INVENTION

A steam generator is a closed, heated vessel or a pressurized pipe system which serves the purpose of generating steam at high pressure and high temperature for heating and operation purposes (e.g. for operating a steam turbine). At especially high steam power and pressure, such as during energy generation in power stations for example, water tube boilers are used in such cases, in which the flow medium—usually water—is located in steam generator tubes. Water tube boilers are also used with solid-fuel combustion, since the combustion chamber in which heat is generated by combustion of the respective raw material can be designed in any given manner by the arrangement of pipe walls.

This type of steam generator constructed as a water tube boiler thus comprises a combustion chamber, the peripheral wall of which is formed at least partly from pipe walls, i.e. gas-proof, welded steam generator pipes. On the flow medium side these steam generator pipes initially form an evaporator, into which the unevaporated medium is introduced and evaporated. The evaporator in such cases is usually arranged in the hottest area of the combustion chamber. Connected downstream from it on the flow medium side might be a device for separation of water and steam and a superheater, in which the steam is heated further beyond its evaporation temperature, in order to obtain a high level of efficiency in a following thermal power machine, such as a steam turbine for example. A preheating device (so-called economizer) can be connected upstream from the evaporator in the upstream generator, which preheats the feed water by utilizing the waste or residual heat and in this way likewise increases the efficiency of the overall system.

Depending on the design and geometry of the steam generator, further steam generator pipes can be arranged within the combustion chamber. These can be combined or welded into an inner wall for example. Depending on the desired arrangement of steam generator pipes or inner walls within the combustion chamber, it can be necessary in such cases to connect inner walls on the flow medium side behind one another and to connect their steam generator pipes via an intermediate collector. In the intermediate collector the medium flow from the upstream inner wall is merged and serves as an inlet collector for the downstream inner wall.

In specific operating states however a steam content greater than zero can be produced in the intermediate collector. With such a steam content an even distribution of the medium to the downstream inner wall is not possible with a simple collector, so that water-steam mixture separation can occur. Individual pipes of the downstream inner wall can thus already have such a high steam contents or enthalpies at their inlet that an overheating of these types becomes very probable. Such an overheating can lead in operation over the longer term to pipe damage.

SUMMARY OF THE INVENTION

The object of the invention is thus to specify a steam generator and a method for operating a steam generator of the above type which makes it possible for the steam generator to have an especially long service life and be especially reliable.

This object is inventively achieved by the flow medium at an inlet of the inner wall connected downstream from the intermediate collector having a lower temperature than the flow medium at an inlet of the peripheral wall.

The invention here is based on the idea that an especially high service life and especially little need for repair to a steam generator would be able to be achieved by avoiding overheating of the steam generator pipes through disproportionately high steam contents or enthalpies. In such cases these high steam contents especially occur with intermediate collectors by partly evaporated flow medium being distributed unevenly to the downstream steam generator pipes. This uneven distribution is thus to be prevented by avoiding a two-phase mixture of water and steam in the intermediate collector. This would be achievable by the inner walls upstream from the intermediate collector not consisting of pipes, so that the medium is undercooled and enters the intermediate collector without further preheating. However this solution brings with it constructional disadvantages. Thus the temperature of the flow medium at the inlet into the steam generator is to be reduced instead.

However a reduction in the inlet temperature of the flow medium leads to a lower efficiency of the steam process. This is not desirable, also this type of reduction into fewer heated steam generator pipes or in pipe walls without intermediate collectors—especially in the peripheral walls of the steam generator—is not necessary. Therefore in these steam generator pipes there is to be no reduction of the entry temperature in order to improve the efficiency. This is able to be achieved by the flow medium having a lower temperature at the entry of the inner wall downstream from the intermediate collector than the flow medium at an entry of the peripheral wall.

The combustion chamber of the steam generator advantageously features a fluidized bed combustion device. The combustion takes place in such cases in a fluidized bed made of pulverized solid fuel and hot combustion air. The fuel is held suspended and fluidized above the nozzle bed. The pulverized fuel particles have a large surface so that good combustion can take place. The strong turbulence flow results in a very good pulse and heat exchange, so that an even temperature obtains in the fluidized bed. With fluidized bed combustion very low nitrous oxide emissions can be maintained.

In steam generators of a comparatively large design with fluidized bed combustion the flow inlet side lower combustion zone should be divided into two. Such a "pant leg" design achieves a better mixing of the fuel mixture and thus fewer possible distribution problems.

Thus in a further advantageous embodiment, two inner walls partly formed from further steam generator pipes arranged symmetrically in the combustion chamber are connected upstream of the intermediate collector on the flow medium side. With such a pant leg design steam generators an intermediate collector is necessary at the transition to the upper combustion zone, so that here in particular the described problems of uneven further distribution occur especially frequently. Lower temperatures at the inlets of the inner walls upstream of the intermediate collector are thus of particular advantage here.

In particular fluidized bed boilers with a pant leg design have been embodied especially frequently as drum boilers, i.e. the heated medium is separated at the outlet of the evaporator in a water-steam drum into its water and steam component. In such a steam generator the problem described above, as a result of the higher medium flow, occurs in the background. The embodiment described above also makes it possible for the boiler to be designed as a once-through flow boiler, which immediately brings a number of advantages: once-through flow steam generators can be used both for undercritical and also for overcritical pressure without changing the method technology. Only the wall thicknesses of the pipes and collectors must be dimensioned in accordance with the intended pressure. The once-through flow principle is thus in line with the internationally discernible trend for improving the efficiency by increasing the steam states. Furthermore operation of the entire system at variable pressure is possible. In variable pressure operation the temperatures in the high-pressure part of the turbine remain constant in the entire load range. Because of the larger dimensions in respect of diameter and wall thicknesses of the components, the turbine is significantly more heavily loaded than the boiler components. Thus advantages are produced with variable pressure operation in respect of load change speeds, number of load changes and starts. Advantageously the steam generator is thus designed as a once-through flow boiler.

To improve the efficiency or to optimize the heating surface arrangement an economizer device is preferably connected upstream from the inlets of the peripheral walls and of the inner walls of the steam generator. This uses waste heat to preheat the flow medium. In this way a higher overall efficiency of the steam generator is achieved by the lower exhaust gas temperature created by using the waste heat. An especially simple construction of a steam generator is thus possible, in that the different temperature at inner wall and peripheral wall of the steam generator can be achieved by constructional measures at the economizer device, i.e. by provision of media with a different degree of preheating. To this end the economizer device is preferably designed such that flow medium intended for the inlet of the inner wall connected upstream of the intermediate collector experiences a lower heat input than the flow medium intended for the inlet of the peripheral wall. To this end the economizer device can comprise a number of economizers which are connected accordingly.

In an advantageous embodiment a bridging line branches off before the flow medium-side inlet of an economizer, which opens out into the inlet of an inner wall connected upstream from the intermediate collector or the inner walls connected upstream from the intermediate collector. In this way in a simple constructional manner, bypassing of the economizer of the economizer device is achieved and thus a lower heat input into the bridged part of the flow medium is obtained. The bridged part of the flow medium can then be mixed in the desired quantity with a part of the non-bridged part and an especially simple reduction of the temperature of the flow medium supplied to the inner walls is achieved.

Advantageously the bridging line in such cases comprises a throughflow control valve. In this way the quantity of diverted flow medium is able to be adjusted even during operation in an especially simple manner and simple temperature regulation is made possible.

In a further advantageous embodiment a first economizer is connected upstream of the inlets of the inner wall or of the inner walls on the flow medium side and a second economizer is connected upstream of the inlet of the peripheral wall on the flow medium side, whereby the first economizer has a lower heating power than the second economizer. This embodiment with two parallel-switched economizers makes it possible to control the temperature of the flow medium for the inner walls or the peripheral wall separately by appropriate embodiment of the two economizers.

In a further advantageous embodiment a first economizer is connected upstream from the inlets of the inner wall or the inner walls and the inlet of the peripheral wall on the flow medium side and a second economizer is connected upstream from the inlet of the peripheral wall on the flow medium side in series with the first economizer. In this way the entire flow medium initially flows through a first economizer before the flow medium is divided up to create the different temperatures. While in this case a part of the flow medium is supplied to the inlet of the inner walls, another part is supplied to a further economizer and subsequently to the peripheral wall.

In relation to the method the object is achieved by a method for operating a steam generator with a combustion chamber with a peripheral wall formed at least partly from gas-proof welded steam generator pipes, wherein at least two inner walls partly formed from a further steam generator pipes are arranged within the combustion chamber, which are connected one behind the other on the flow medium side by an intermediate collector, and wherein flow medium is supplied at a lower temperature to an inlet of the inner wall connected upstream of the intermediate collector than to an inlet of the peripheral wall.

The advantages achieved with the invention consist in particular of the use of two media with different levels of undercooling for feeding the different evaporator parts (peripheral walls and inner walls) resulting in the problem of water-steam mixture separations in the intermediate collectors being safely avoided. By contrast with a solution with reduced inlet enthalpy for all evaporator parts, the evaporator does not have to be enlarged or only has to be enlarged slightly to guarantee a sufficiently high outlet enthalpy at the evaporator. In such cases the specific design of the economizer device demonstrates especially simple constructional options for making feed water available with different levels of undercooling. In particular an especially high service life of the steam generator with simultaneously high efficiency is achieved.

BRIEF DESCRIPTION OF THE DRAWINGS

An exemplary embodiment of the invention is explained in greater detail with reference to a drawing, in which.

DETAILED DESCRIPTION OF THE INVENTION

Figure 1:
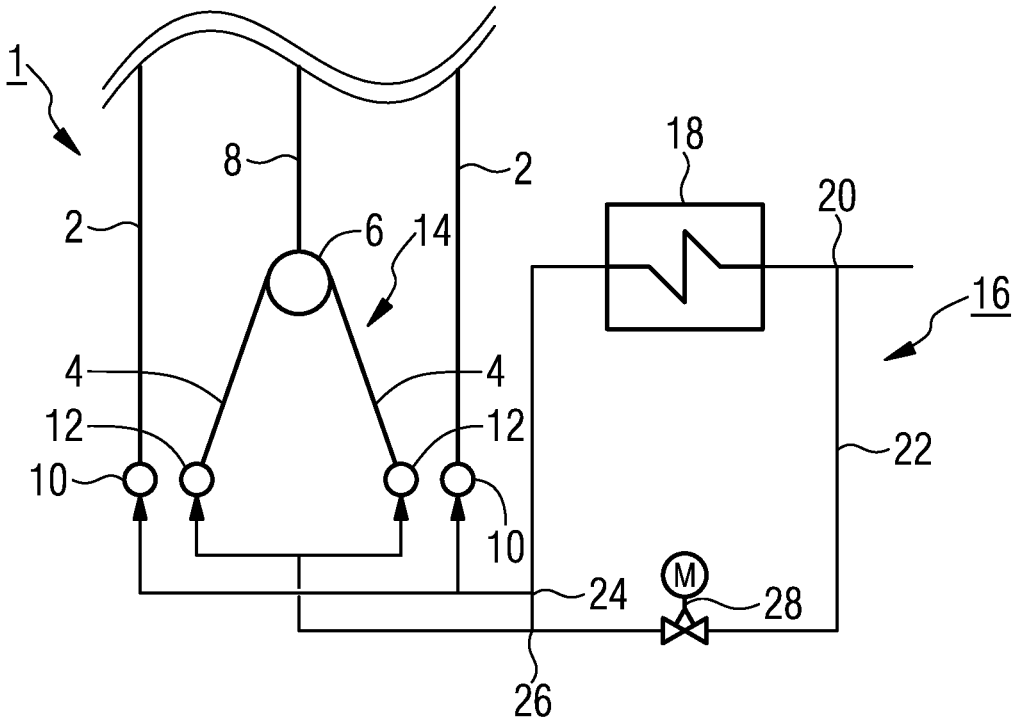
FIG. 1 shows a schematic of the lower part of the combustion chamber of a once-through boiler with fluidized-bed combustion with a partly-bridged economizer.

Parts which are the same are provided with the same reference characters in all figures.

The steam generator 1 shown schematically in accordance with FIG. 1 is embodied as a once-through steam generator. It comprises a number of pipe walls formed from steam generator pipes through which there is an upwards flow, namely a peripheral wall 2 as well as symmetrically-arranged inner walls 4 aligned inclined, downstream from which a further inner wall 8 is connected by an intermediate collector 6 on the flow medium side. The once-through steam generator 1 is thus embodied in what is referred to as the pant-leg design.

Flow medium enters the pipe walls through inlets 10, 12 assigned to the peripheral wall 10 or the inner walls 4 respectively. In the inner space 14 solid fuel is burned in a type of fluidized bed combustion and thus an input of heat into the pipe walls is achieved, which causes a heating and evaporation of the flow medium. If the medium now enters all pipe walls with the same enthalpy, a steam content can already arise in the intermediate collector 6 that is so high that an uneven distribution to the pipes of the inner wall 8 occurs and the pipes with high steam content overheat here.

To avoid the consequential disadvantages such as a shorter service life or greater need for repairs for example, the flow medium supplied to the inner walls upstream from the intermediate collector 6 is at a lower temperature than the medium supplied to the peripheral wall 2. In this case an economizer 16, which guarantees different heat inputs into the different medium flows, is provided in the steam generator 1.

To this end, the economizer device 16 in accordance with FIG. 1 comprises an economizer 18, connected upstream from which on the flow medium side is a branching point 20. A part of the flow medium is thus diverted around the economizer 18 in a bridging line 22. In the flow medium-side direction, connected downstream from the economizer 18 is a further branching point 24, from which a line is routed to the inlets 10 of the peripheral wall 2. A part of the preheated flow medium is thus supplied to the peripheral wall 2. Another part of the preheated flow medium is conveyed in a line, which meets the bridging line 22 at a mixing point 26. Here a medium of slightly lower temperature is obtained by the mixing of the medium flows, which is then conveyed to the inlets 12 of the inner walls 4. The amount of the bridged flow medium and thus the temperature of the flow medium conveyed to the inner walls 4 can easily be regulated by a throughflow regulation valve 28 in the bridging line 22 in this case.

Figure 2:
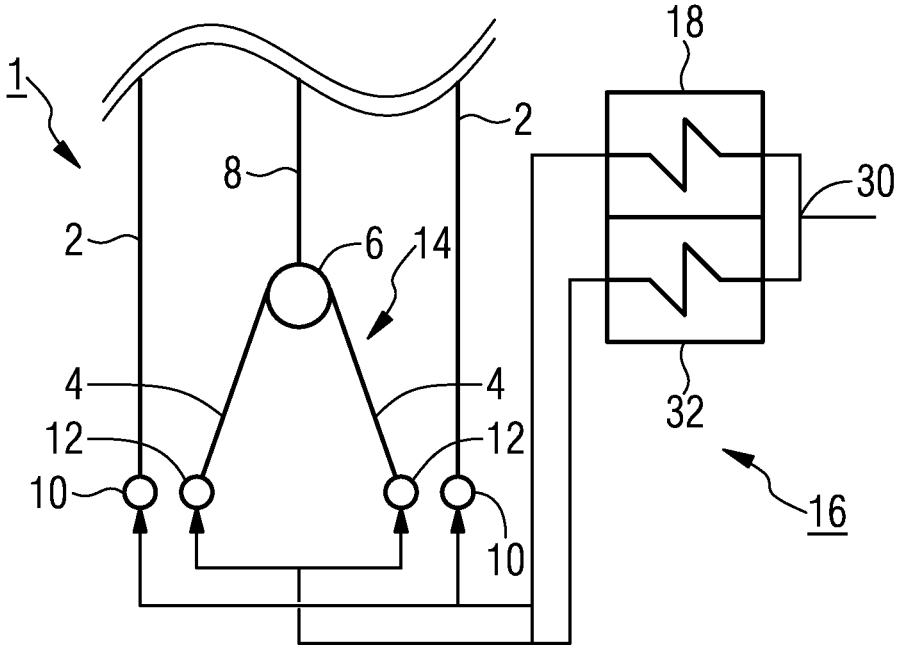
FIG. 2 shows the once-through steam generator from FIG. 1 with parallel economizers.

FIG. 2 shows an alternative embodiment of the invention. The steam generator 1 is identical here to FIG. 1 except for the economizer device 16. The economizer device 16 includes at its flow medium-side inlet a branching point 30, from which two lines lead into two economizers 18, 32. The outlet of the economizer 18 is connected in this case 10 to the peripheral wall 2, while the economizer 32 is connected to the inlets 12 of the inner walls 4. The economizer 32 is now embodied such that it has a lower heat input into the flow medium than the economizer 18. Thus a lower temperature is achieved at the inlets 12 of the inner walls 4 than at the inlets 10 of the peripheral wall 2. A suitable design of the economizers 18, 32 enables the temperature to be adapted to the desired boundary conditions.

Figure 3:
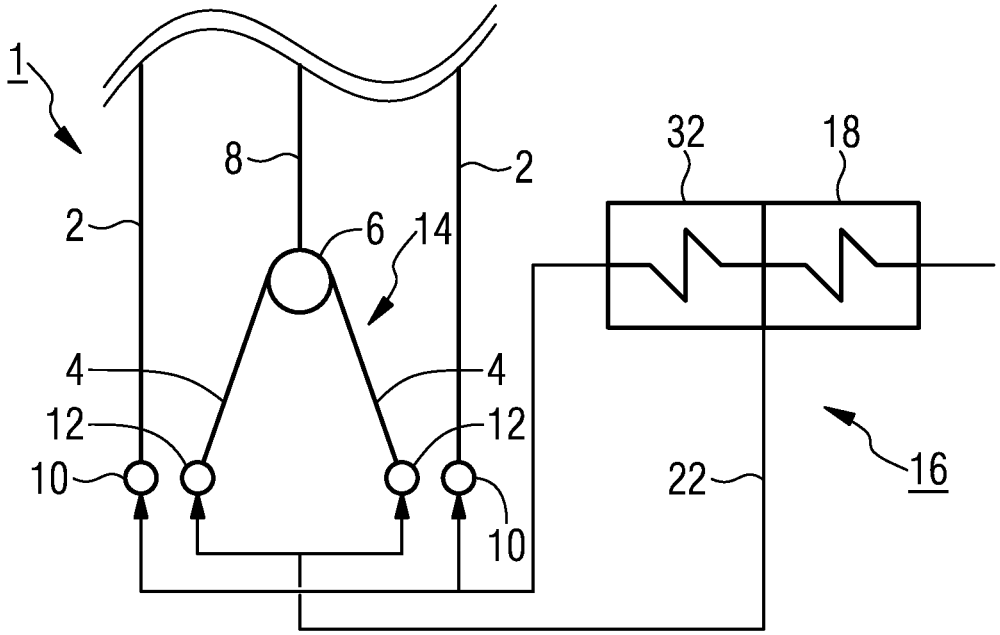
FIG. 3 shows the once-through steam generator from FIG. 1 with series economizers.

A further embodiment of the invention is shown in FIG. 3. Here too the steam generator 1 is identical to FIG. 1, except for the economizer device 16. The economizer device 16, after its flow medium-side inlet, initially contains an economizer 18 in which the entire flow medium is heated. Then a bridging line 22 branches off, which opens out into the inlets 12 of the inner walls 4. A further part of the flow medium is conveyed into a further downstream economizer 32. Here it is heated further and then conveyed through the peripheral wall 4. The additional heating in economizer 32 means that this medium has a higher temperature than the medium conveyed into the inner walls 4.

The invention claimed is:

1. A steam generator, comprising:

a combustion chamber having a peripheral wall formed at least partly from gas-proof, welded steam generator pipes;

an inner wall and a further inner wall formed at least partly from additional steam generator pipes, wherein the inner wall and the further inner wall are arranged inside the combustion chamber, wherein the further inner wall is connected downstream from the inner wall on a flow medium side by an intermediate collector, and wherein a flow medium has a lower temperature at an inlet of the inner wall than a flow medium at an inlet of the peripheral wall, wherein an economizer device is connected upstream of the inlet of the inner wall and upstream of the inlet of the peripheral wall on the flow medium side and uses waste heat to preheat flow medium admitted to the economizer device to produce a preheated flow medium, wherein the flow medium at the inlet of the inner wall has a smaller heat input than the flow medium at the inlet of the peripheral wall, wherein the peripheral wall and the inner wall form an evaporator such that flow medium introduced to the evaporator is evaporated, wherein the steam generator is designed as a once-through boiler, wherein the temperature of the flow medium supplied to the inlet of the inner wall is such that no steam content arises in the intermediate collector, wherein a bridging line branches off before an inlet of a flow medium side of the economizer and opens out into the inlet of the inner wall, and wherein a first part of the preheated flow medium is supplied directly to the peripheral wall from the economizer device and a second part of the preheated flow medium is conveyed via a line to the bridging line such that the second part of the preheated flow medium is mixed with flow medium from the bridging line that has not been preheated by the economizer device thereby making the flow medium at the inlet of the inner wall have a lower temperature than the flow medium at the inlet of the peripheral wall.

2. The steam generator as claimed in claim 1, wherein the combustion chamber comprises a fluidized-bed firing device.

3. The steam generator as claimed in claim 1, wherein the inner wall is arranged symmetrically in the combustion chamber and is connected upstream of the intermediate collector on the flow medium side.

4. The steam generator as claimed in claim 1, wherein the bridging line comprises a flow regulation valve.

5. A method for operating a steam generator having a combustion chamber with a peripheral wall formed at least partly from gas-proof, welded steam generator pipes, comprising:

forming an inner wall and a further inner wall at least partly from additional steam generator pipes;

arranging the inner wall and the further inner wall inside the combustion chamber;

connecting the further inner wall downstream from the inner wall on a flow medium side by an intermediate collector;

connecting an economizer device upstream of an inlet of the peripheral wall on the flow medium side;

preheating a flow medium admitted to the economizer device utilizing waste heat to produce a preheated flow medium;

supplying by the economizer device a flow medium having a lower temperature at an inlet of the inner wall than a flow medium supplied at the inlet of the peripheral wall such that no steam content arises in the intermediate collector; and providing a bridging line that branches off before an inlet of a flow medium side of the economizer and opens out into the inlet of the inner wall, wherein the peripheral wall and the inner wall form an evaporator such that flow medium introduced to the evaporator is evaporated, wherein the steam generator is designed as a once-through boiler, and wherein a first part of the preheated flow medium is supplied directly to the peripheral wall from the economizer device and a second part of the preheated flow medium is conveyed via a line to the bridging line such that the second part of the preheated flow medium is mixed with flow medium from the bridging line that has not been preheated by the economizer device thereby making the flow medium at the inlet of the inner wall have a lower temperature than the flow medium at the inlet of the peripheral wall.

* * * * *